United States Patent [19]

Bachmann

[11] 4,052,981

[45] Oct. 11, 1977

[54] MASSAGING METHOD AND APPARATUS

[76] Inventor: Robert J. Bachmann, 635 Highland Ave., Cherry Hill, N.J. 08034

[21] Appl. No.: 711,298

[22] Filed: Aug. 3, 1976

[51] Int. Cl.[2] ..... A61H 9/00

[52] U.S. Cl. ..... 128/36

[58] Field of Search ..... 128/32-36, 128/41, 26, 24 Z, 55, 24 R

[56] References Cited

U.S. PATENT DOCUMENTS

| | | | |
|---|---|---|---|
| 2,882,892 | 4/1959 | Kosior | 128/24 R |
| 3,019,785 | 2/1962 | Eiden | 128/33 |
| 3,028,857 | 4/1962 | Parker | 128/24 R |
| 3,557,781 | 1/1971 | Kaye | 128/32 |
| 3,585,990 | 6/1971 | Blachly et al. | 128/36 |
| 3,763,853 | 10/1973 | Jochimski | 128/36 |

*Primary Examiner*—Lawrence W. Trapp

*Attorney, Agent, or Firm*—Larson, Taylor and Hinds

[57] ABSTRACT

The present invention provides a method and portable apparatus for massaging particular portions of the body. In one embodiment, the invention comprises a face mask made out of a pliable member and having a plurality of compressible fingers mounted on the inner surface of the face mask for contacting and massaging the face portion. The vibrations are generated by a plurality of coaxially arranged, separately energized motors having weights slidably mounted for radial movement to the shafts of the motors. The motors can be energized through a pulse generating network which supplies power having an oscillating amplitude which produces a corresponding oscillation of the speed of the motors. By setting the speeds of the motors so as to produce beats, a complex vibrational wave is generated in which the vibrational beat frequency is modulated by or modulates the oscillating amplitude of the speed of the motors.

7 Claims, 7 Drawing Figures

FIG. 5
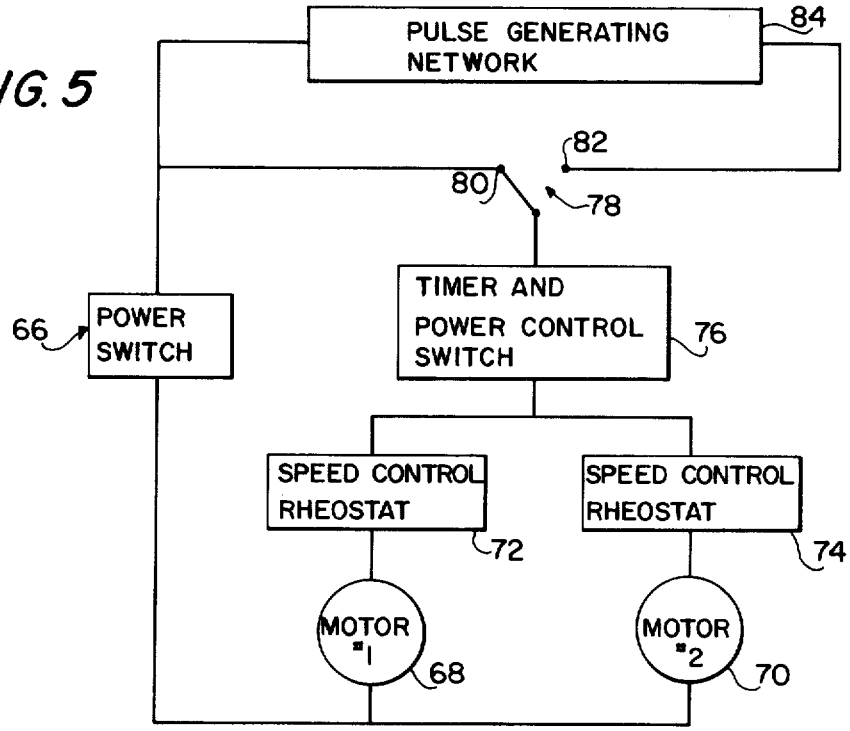
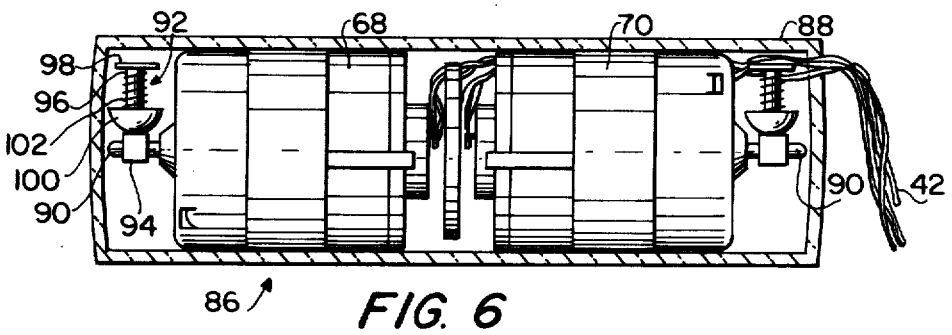
FIG. 6
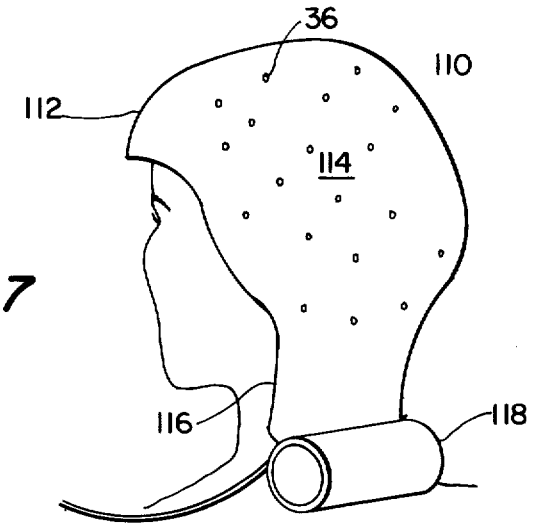
FIG. 7

MASSAGING METHOD AND APPARATUS

BACKGROUND OF THE INVENTION

1. Field of the Invention

The present invention relates to methods and apparatus for massaging subjects such as persons and in particular relates to massaging methods and massaging devices using and having a pliable form fitting cover conforming to the area to be massaged.

2. Description of the Prior Art

The prior art is replete with devices for massaging various portions of the body of a person or of another animal. The devices can be broadly classified into those that are shaped to fit the portion to be massaged, such as a head cap or face mask, and those that are not, such as vibrating chairs and pillows, and hand-held massaging devices.

The objective of most massaging devices is to treat a portion of the body by rubbing, kneading, tapping, or vibrating it in order to stimulate circulation, increase suppleness and relax muscles. Proper massaging of a body portion has been found to produce relief from headaches and muscle spasms, releave tension, remove lines and other complexion disfigurements, reduce hair loss, and tighten the skin.

The prior art devices usually have been able to effectively treat a relatively small portion of the body in one or two of these methods, such as to rub and knead the body or rub and vibrate the body portion. However, these devices are ineffective for treating the body simultaneously with all four methods or for treating a relatively large portion of the body, such as an entire face or scalp, in one of two of these methods. Furthermore, the prior art devices which are not shaped to fit the body portion to be massaged, cannot treat the entire area simultaneously.

The failure of the prior art devices appears to be the inability of the devices to produce the proper combinations of motions and to transmit the motions simultaneously over a large area of the entire body portion.

A further disadvantage of the prior art devices is that most of the devices which are capable of massaging large body portions are heavy, bulky, and not portable. On the other hand, any device which is portable, does not produce a satisfactory massage over a large body portion. For example, many of the prior art devices produce uncomfortable pounding or shaking at certain vibration levels. In addition, many of the prior art devices produce a satisfactory massage to the areas proximate to the vibration generating means, but do not produce a satisfactory massage at areas distal to the vibration generating means because of improper conduction of the vibrations to the distal areas and thence to the portion to be massaged.

SUMMARY OF THE INVENTION

The present invention overcomes these and other disadvantages of the prior art devices by providing a completely portable, relatively light-weight massaging device to be worn by the user for simultaneously rubbing, kneading, tapping and vibrating a relatively large area of the body, such as an entire face or scalp. The present invention combines a unique rhythm generating vibrator with a pliable mask unit having mounted on the interior surface thereof a plurality of flexible and resiliently compressible finger-like projection and the combination produces the aforementioned result. In addition, it has been found that a device according to the present invention can be comfortably used for extensive periods of time because of its smoothness of operation and light weight.

A device in accordance to the present invention comprises an electrically operated vibration generating means, a pliable member on which the vibration generating means is mounted, a plurality of flexible and resiliently compressible fingers mounted at one end thereof to the internal surface of the pliable member, and means for supplying electrical power to the vibration generating means. The vibration generating means includes a housing which is mounted along one edge of the pliable means, and a plurality of variable speed motors mounted on the housing. In one embodiment of the invention, each motor includes a shaft rotated thereby, a weight mounted on the shaft for perpendicular movement in a radial direction with respect to the shaft upon the rotation thereof, and spring means mounted to the shaft for resiliently opposing the outward radial movement of the weight. In a further embodiment of the invention, the means for supplying electrical power includes a means for regulating the speed of each motor and a means for converting non-pulsating direct current or rectified alternating current electrical power into pulsating electrical power.

A method in accordance with the present invention comprises applying a device in accordance with the invention to the part of the body to be massaged, supplying regularly pulsating electrical power to the motors, thereby varying the speed of the motors and producing rhythmatic vibrations and adjusting the speeds of the electrical motors so as to produce vibrational beats.

These and other features and advantages of the present invention will be stated in or obvious from the following description of a presently preferred embodiment of the invention described hereinbelow.

BRIEF DESCRIPTION OF THE DRAWINGS

FIG. 5 is an electrical schematic, block diagram of a portable power supply in accordance with the invention.

FIG. 6 is a partially cut away front elevation view of vibration generating motors.

FIG. 7 is a perspective view of another embodiment of the invention for massaging the scalp.

DESCRIPTION OF THE PREFERRED EMBODIMENTS

Figure 1:
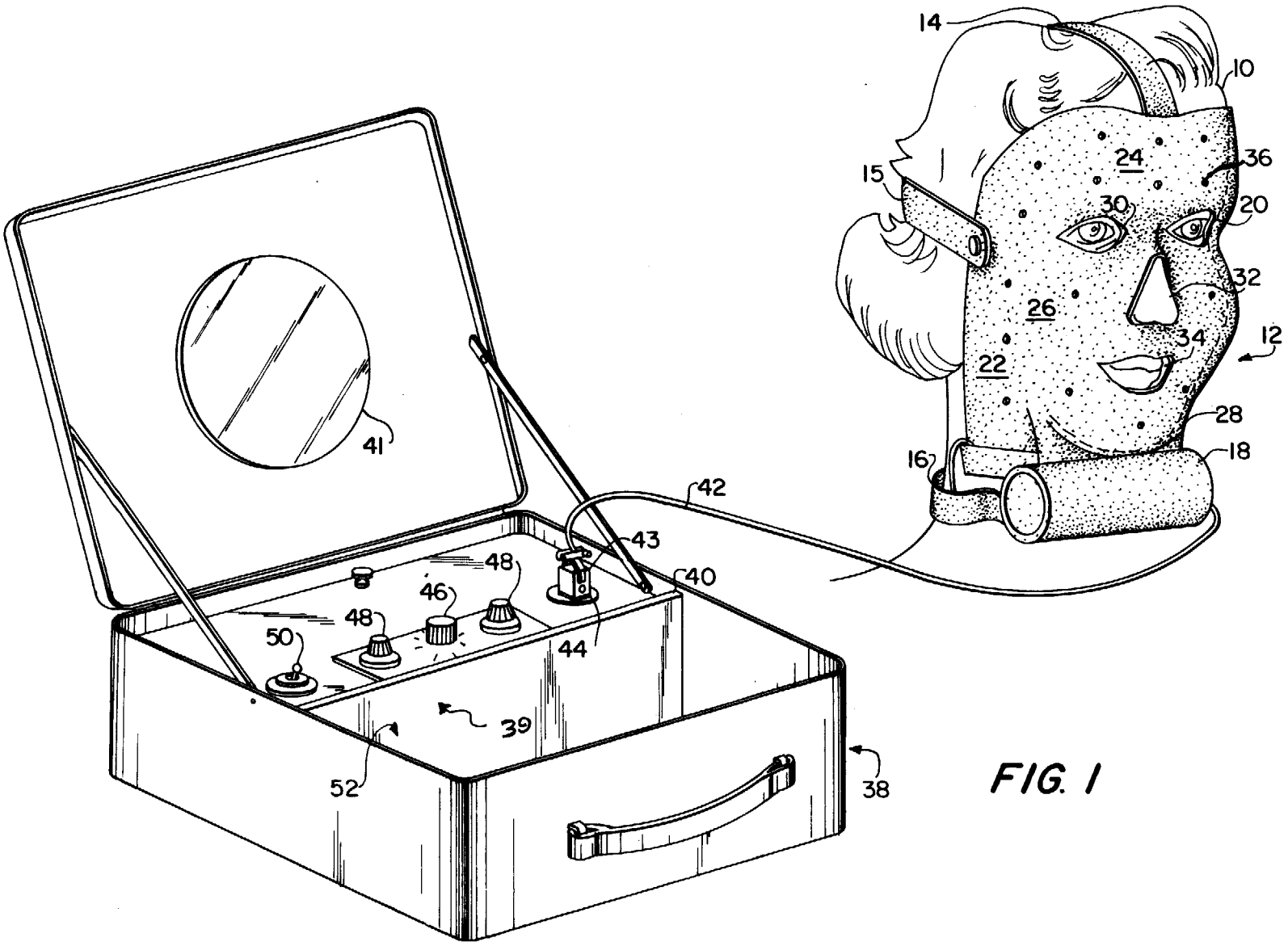
FIG. 1 is a perspective view of a person wearing a face massaging device and of a portable carrying case and power supply in accordance with the invention.
Figure 2:
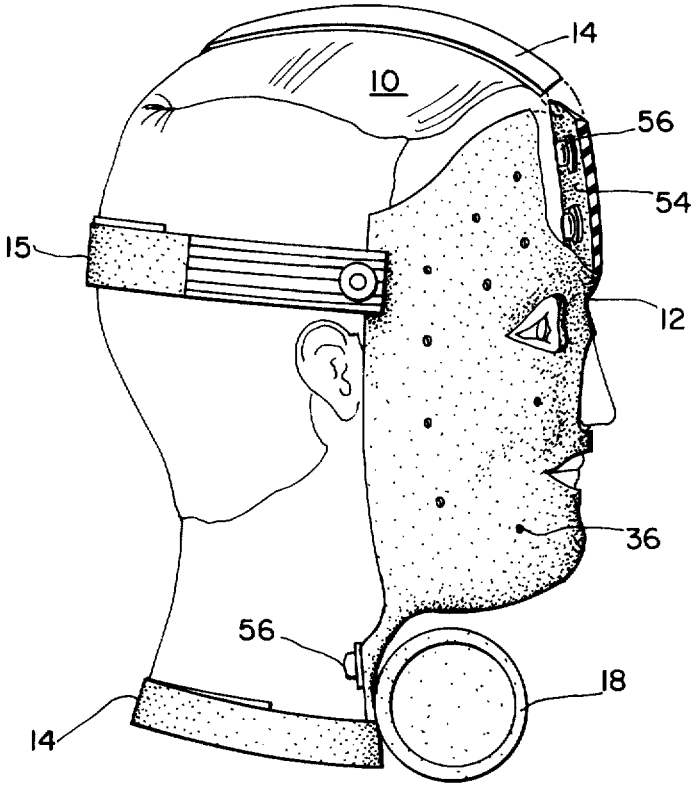
FIG. 2 is a side elevation view of the face massaging device of FIG. 1 with a part thereof cut away.
Figure 3:
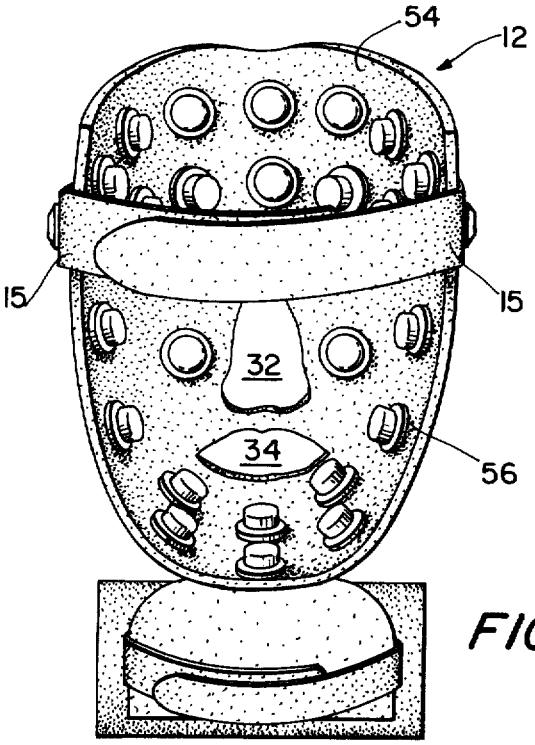
FIG. 3 is a rear elevation view of the face massaging device of FIG. 1 showing a plurality of massaging fingers.

A massaging apparatus for massaging the face of a person is shown in FIGS. 1, 2 and 3. A person 10 is depicted wearing a pliable member or covering in the shape of a face mask 12 which is mounted over the face of person 10 with top mounting straps 14, central mounting straps 15, and lower mounting straps 16. Attached at the lower edge of face mask 12 is a housing 18 for holding a vibration generating means comprised of a plurality of motors as further described hereinbelow.

Face mask 12 can be manufactured by, for example, moulding it from a flexible plastic material, from a man made rubber like compound, or from a natural rubber compound. In any event, it is preferable that the material or substance out of which face mask 12 is made has the general characteristics of being flexible, pliable, resilient, and somewhat elastic, yet also having sufficient rigidity that it will maintain its shape independent of external support. Face mask 12 is comprised of a front part 20, side parts 22, and upper forehead section 24, a middle cheek section 26, and a lower chin and neck section 28. Face mask 12 is further provided with openings 30, 32, and 34, respectively, for the eyes, nose, and mouth of the user. A plurality of orifices 36 are located over the entire surface of face mask 12.

Face mask 12 can be conveniently stored in a carrying case 38 which also contains a control panel 39 and a power supply 40 located inside control panel 39. A mirror 41 is mounted on the inside of the cover to carrying case 38. Flexibility for the user of the massaging apparatus is enhanced by removably connecting the vibration generating means to control panel 39 and portable power supply 40 with a detachable connecting means comprising a wire 42 having a plug 43 at one end thereof. Plug 43 plugs into a receptacle 44 mounted on the top of control panel 39. Control panel 39 also has mounted thereon a timer control knob 46, and a plurality of rheostat control knobs 48 equal in number to the number of motors in the vibration generating means. The rheostat control knobs 48 can be used to independently control the speed of each motor. Lastly, a pulsator switch knob 50 is used to select either a constant voltage from power supply 40, which can be comprised of batteries, or a voltage having a slowly oscillating or pulsating amplitude. Located in front of control panel 39 is a compartment 52 in which face mask 12 can be stored.

With particular reference to FIGS. 2 and 3, it can be seen that on the inner surface 54 of face mask 12 there are mounted a plurality of inward projecting hollow fingers 56. Fingers 56 at their inward end engage the facial and neck areas of the person 10 using the massaging device and transmit the vibrations of the various portions of face mask 12 to the body of the person 10 using the device.

Figure 4:
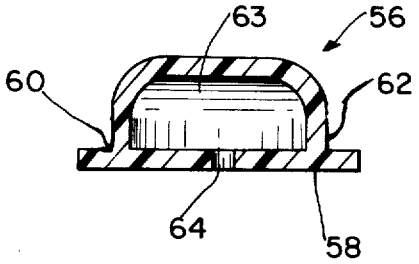
FIG. 4 is an enlarged cross-sectional elevational view of one of the massaging fingers of FIG. 3.

As best seen in FIG. 4, finger 56 includes in the preferred embodiment a mounting plate 58 for mounting finger 56 onto inner surface 54 of face mask 12, a base section 60 which is resilient but substantially not compressible, and a compressible diaphragm section 62 which together defines an inner cavity 63. Extending through base section 60 of finger 56 is a bore 64 which is in communication with cavity 63 at one end and a corresponding orifice 36 in face mask 12 (see also FIG. 2) at the other end. Thus a free flow of air is permitted between cavity 63 and the area external of mask 12. By permitting free flow of air into and out of cavity 63 as fingers 56 are vibrated into compression and expansion, a suction effect is created and a greater degree of compressibility of fingers 56 is provided.

The electronic control circuit for providing pulsating power to vibration generating means is depicted in FIG. 5. A low voltage DC power supply 66 is connected in parallel to a first and a second DC motor, 68 and 70 respectively, for providing DC power thereto. Power supply 66 can simply be comprised of batteries or can be comprised of a regular AC 120 or 240 volt power source, a transformer to lower the voltage to approximately 6 to 12 volts AC, and a rectifier. Motors 68 and 70 are electrically connected to respective speed control rheostats 72 and 74, which are operated by rheostat control knobs 48 so that the speed of the corresponding motor can be varied. A timer and power control switch 76 is connected in series with the parallel combination of motors 68 and 70 and controls the power supplied thereto through a timer. Hence, it is possible to adjust timer and control switch 76 through timer control knob 46 to provide a timed amount of power to motors 68 and 70. A pulsator switch 78 operated by pulsator switch knob 50 selectively connects timer and power control switch 76, and hence the parallel combination of motors 68 and 70, in a first position in electrical contact with a contact 80 to power supply 66, and in a second position in electrical contact with a contact 82 to power supply 66 through a pulse generating network 84. Pulse generating network 84 is conventional in nature and comprises well known oscillating circuits for converting the amplitude of the output voltage from power supply 66 from a constant value to a slowly oscillating or pulsating valve.

A preferred embodiment of a vibration generating means 86 in accordance with the invention is depicted in FIG. 6. Vibration generating means 86 is comprised of two completely independent DC motors 68 and 70 located inside a tubular motor housing 88 in a back to back coaxial arrangement. Motor housing 88 has an outer diameter such that it can be removably inserted into housing 18 in a snug relationship therewith.

Power is supplied to motors 68 and 70 through wire 42 which is connected to the inward facing ends of the respective motors. Because motors 68 and 70 are substantially identical, only motor 68 will be described in greater detail. Extending from the outwardly facing end of motor 68 and rotated thereby is a shaft 90. An arm 92 is rigidly journaled onto shaft 90 at one end 94 and is rotated thereby. Arm 92 further comprises a middle shaft section 96 and a base section 98 attached at the radially outward end of shaft section 96 and integral therewith. An annular weight 100 having a semicircular cross section is slidably mounted on shaft section 96 and is retained in abutting relationship with journaled end 94 of arm 92 by a spiral spring 102. As shaft 90, and therefore arm 92, is rotated by motor 68, weight 100 is forced radially outward against spring 102 by centrifugal force. Consequently, the faster motor 68 is operated, the more centrifugal force is developed and the greater will be the displacement of weight 100 from end 94 of arm 92. The resulting vibrations developed by motor 68 are smoother for any given speed since weight 100 is maintained in an optimum position for each speed of motor 68. As a result, the continuous train of soothing vibrations produced has a substantially uniform pattern and an amplitude determined by the rotational speed of motor 68, providing a more penetrating and gentler massage.

A second embodiment of the invention is depicted in FIG. 7. In this embodiment, the pliable member is in the shape of a cap, designated 110, and is for massaging the scalp and neck of the user. Cap 110 comprises a forehead section 112, a generally semi-hemispheriodal main section 114, and a neck section 116. Rigidly attached at the bottom edge of neck section 116 is a housing 118 for removably receiving the motor housing 88 of the vibration generating means.

The primary purpose of locating either housing 18 in FIG. 1 and housing 118 in FIG. 7 at the bottom edge of the respective massaging apparatus is to permit each massaging apparatus to have as low a center of gravity as possible and to provide and gravitational force tending to pull the respective massaging apparatus downwardly. As a result, the vibrations are generated in the lowest section of the pliable member and transmitted by the pliable member itself in an undulating manner.

In use, a pliable member having a shape conforming to the portion of the body to be massaged is attached over that portion and the vibration generating unit is inserted into the corresponding housing. Timer control knob 46 is then rotated to set timer and power control switch 76 to the time period for which the massage is to be administered. This energizes motors 68 and 70. Speed control rheostat 72 and 74 are adjusted so as to operate their respective motors 68 and 70 at different speeds. The respective speeds of motors 68 and 70 preferably are chosen so as to generate a train of beats. When pulsator switch knob 50 is positioned to the second position so as to connect pulse generating network 84 into the circuit, the constant amplitude of power from battery 66 is transformed into a pulsating amplitude thereby causing the speed of motors 68 and 70 to repeatedly increase and decrease. In other words, the wave of beats generated by the motors operating at different speeds is modulated by the pulsating amplitude of the power supply with the net result that a unique, complex vibrational motion is generated by the vibration generating means. This vibration is transmitted through the pliable member to the fingers 56 projecting inwardly from the inside surface of the pliable member and which contact at their radially inward end the portion of the body to be massaged. The complex vibration of fingers 56 massage the portion of the body they are in contact with through a rubbing, kneading, tapping, and vibrating motion. Fingers 56 are permitted a greater freedom and ease of movement since they are hollow and the air located in cavity 63 can readily communicate with the air outside the pliable member through orifice 36.

Although the invention has been depicted in the afore-described presently preferred embodiments, other variations, modifications, and embodiments of the invention will be obvious to those skilled in the art. Thus, for example, the projecting fingers can be comprised of solid sponge-like material to provide the requisite resiliency and compressibility, thereby eliminating the need for any orifices in the pliable member. In still other embodiments of the invention, the orifices in the pliable member can be eliminated altogether and the projecting fingers can have a bore from the free end thereof in communication with a cavity therein. This particular type of finger would create a suction effect on the portion of the body to be massaged. In still further embodiments of the invention, it would be readily obvious to make the pliable member in any desired shape to conform to and massage a particular portion of the body.

Although the invention has been described in detail with respect to exemplary embodiments thereof, it will be understood by those of ordinary skill in the art that still further variations and modifications may be effected within the scope and spirit of the invention.

What is claimed is:

1. A portable device conforming to a body portion of an animal for massaging the body portion, said device comprising:

a means for generating a plurality of vibrations which includes a housing, and a plurality of variable speed motors mounted on said housing;

a pliable member with an external surface and an internal surface having a shape conforming to the part of the body to be massaged, said housing being mounted to said pliable member along one edge thereof; and a plurality of flexible and resiliently compressible finger-like members mounted at one end thereof to said internal surface of said pliable member, the other end of said finger-like members for engaging the surface of the body portion to be massaged.

2. A portable massaging device as claimed in claim 1 wherein each said motor has a shaft rotatable by the motor, a weight mounted on the shaft for perpendicular movement in radial direction with respect to said shaft upon the rotation thereof, and spring means mounted to said shaft for resiliently opposing the outward radial movement of said weight.

3. A portable massaging device as claimed in claim 1 and further including means for supplying pulsating electrical power to said motors, said means comprising means for receiving a non-pulsating electrical power, means for distributing said power to said motors which include a means for regulating the speed of each motor, and means for converting said electrical power into pulsating electrical power.

4. A portable massaging device as claimed in claim 1 wherein said finger-like member has a hollow interior cavity and is comprised of a diaphragm section for providing compressibility thereto, and wherein said pliable member has a plurality of apertures therethrough, said apertures being in communication with corresponding cavities of said finger-like members, thereby permitting air external to said pliable member to communicate with said cavity during the compression and expansion of said finger-like members.

5. A portable massaging device as claimed in claim 1 for massaging the face of a human user wherein said pliable member comprises a face-mask having openings therein for the eyes, nose and mouth of the user and a lower section extending below the mouth and chin of the user for engaging the neck of the user, said housing being mounted on the bottom edge of said lower section, and further including releasibly adjustable restraining means for securing said face mask on the face of the user.

6. A portable massaging device as claimed in claim 1 for massaging the scalp of a human user wherein said pliable member comprises a cap section adapted to be fitted onto the head of the user and to substantially cover the scalp area when so fitted, and a lower section integral with said cap section and adapted to substantially cover the neck area of the user, said housing being mounted on the bottom edge of said lower section.

7. A method for massaging a body portion of an animal comprising the steps of:

attaching over the portion to be massaged a pliable covering having a shape generally conforming to the portion to be massaged and comprising a plurality of flexible and resiliently compressible fingers for engaging, at one end thereof, the surface of the portion to be massaged and mounted at the other end thereof to the internal surface of said pliable covering, and a vibration generating means mounted to the lower edge of said attached pliable covering and including a plurality of variable speed motors in coaxial alignment, each motor having a shaft and a radially movable weight rotated thereby;

energizing said motors with a pulsating power supply such that the speed of said motors repeatedly increses and decreases; and adjusting the speed of said motors such that each said motor operates at a different speed from the other said motor and said motors generate a train of beats.

* * * * *